United States Patent [19]

Hjalmer et al.

[11] Patent Number: 4,686,918

[45] Date of Patent: Aug. 18, 1987

[54] METHOD AND APPARATUS FOR MAKING TUFTED BUFFING PADS OF VARIED DENSITY

[75] Inventors: William D. Hjalmer; Hutchinson W. Carns, both of Chester, S.C.

[73] Assignee: Schlegel Corporation, Rochester, N.Y.

[21] Appl. No.: 872,705

[22] Filed: Jun. 10, 1986

[51] Int. Cl.[4] ..... D05C 17/02

[52] U.S. Cl. ..... 112/410; 15/180; 15/230; 15/230.13; 15/230.16; 112/80.23; 112/80.3; 112/121.11; 112/121.12

[58] Field of Search ..... 112/80.23, 80.3, 266.12, 112/121.11, 121.12, 121.16, 410, 121.24; 15/180, 230, 230.13, 230.16

[56] References Cited

U.S. PATENT DOCUMENTS 2,662,277 12/1953 Lacey ..... 112/410
2,871,495 2/1959 Kazimierczak ..... 15/180
4,074,385 2/1978 Howard et al. ..... 15/180
4,271,357 6/1981 Caron ..... 15/180

*Primary Examiner*—Ronald Feldbaum
*Attorney, Agent, or Firm*—Cumpston & Shaw

[57] ABSTRACT

A method and apparatus is disclosed for making improved tufted buffing pads of varied density across the face surface thereof. The apparatus comprises a tufting machine for placing pile in a spiral or circular pattern on a backing pad to form the buffing pad. The backing pad is held by a rotatable and laterally-movable pad holder which is coupled to a programmable controller. An improved buffing pad of varying density is achieved by coupling a programmable computer to the programmable controller for varying the length of intermittent steps that the pad holder is laterally moved relating to the tufting machine. By proper programming, pile applied to the backing pad is maximized in a selected high-wear area of the buffing pad, and minimized in a selected low-wear area of the buffing pad.

2 Claims, 5 Drawing Figures

METHOD AND APPARATUS FOR MAKING TUFTED BUFFING PADS OF VARIED DENSITY

FIELD OF THE INVENTION

The present invention relates generally to tufted buffing pads, and more specifically to a method and apparatus for making improved tufted buffing pads of varied density across the face surface thereof.

BACKGROUND OF THE INVENTION

It is generally known in the art to make tufted buffing pads by placing pile on the face surface of a backing pad with a tufting machine by starting near (one edge) of the backing pad and then sewing in a spiral or circular pattern to the other edge of the pad. Lateral movement of the backing pad in equal increments to place the piles in radially outwardly increasing spirals or concentric circles is accomplished by using the previous row of pile to push the pad outward, or by using a positive indexing means. The tufted buffing pads achieved by these prior known means are of constant density on the face surface thereof from its center to the outer periphery. A problem presented by such buffing pads when used in buffing or polishing applications is that high-wear pile areas of the buffing pad will wear down faster than the remaining low-wear pile areas resulting in a buffing pad that is worn out and no longer suitable for use, even though low-wear areas of the buffing pad are still in good condition. This is extremely wasteful of pile material and costly to the consumers.

There is a need, therefore, of an apparatus and method for solving the problems presented by the prior known tufted buffing pads. This was achieved by the method and apparatus of this invention for making improved tufted buffing pads of varied density on the face surface thereof, in which the pile density is low in low-wear areas and high in high-wear areas. Such buffing pads would be less costly to manufacture, requiring less pile material, would be more reliable in operation, and would have a longer life.

In U.S. Pat. No. 3,459,145, a self-programmed automatic embroidery system is disclosed which includes means to detect the edge of a workpiece or a heavy line drawn thereon, and to stitch around the edge of the workpiece or along the heavy line drawing exclusive of any external control. A read head is provided which is adapted to rotate around a needle axis. The output of the read head is converted into a pulse signal which is fed to an electrical step motor which drives a workpiece orientation feed guide means in a step-by-step manner either in a clockwise or counterclockwise direction, as required, to maintain the read head in its proper position to read the edge of the workpiece. Such a self-programmed automatic embroidery system is ineffective to solve the aforementioned problems presented by prior known tufted buffing pads of constant density on the face surface thereof.

In U.S. Pat. No. 3,367,294, a tufting machine pattern control arrangement is disclosed for use in making carpets or like fabrics wherein a pattern is formed in the work by selectively commanding the formation of pile loops of normal or reduced height respectively, by means such as a pattern drum. However, such a tufting machine pattern control arrangement would be wholly incapable of manufacturing a tufted buffing pad having low pile density in areas of low-wear, and a high density of pile in areas of high-wear.

In U.S. Pat. No. 3,385,244, an electronic control system for an automated sewing machine apparatus is disclosed. The control system and apparatus contemplates coupling electrical step motors to a work frame, such as a cloth frame, to supply a controlled intermittent step motion in both an X and a Y coordinate axis with respect to a sewing machine head each time the needle in the sewing machine head is out of the cloth during each stitching cycle. The motion of the cloth frame is controlled by means of a perforated tape reader, which feeds electrical signals into an X and Y logic circuit. A timing means is also coupled thereto for supplying enabling gates which allow command signals to be coupled to the step motors at selected times during which the needle is out of the cloth. The work frame is adapted to step in either the X or Y direction several times in response to information fed from the tape reader during each stitching cycle. Although the disclosed high-speed digital electronic controlled system is effective for operating one or more sewing machines in accordance with a prerecorded program, it would be ineffective for solving the problems presented by a prior known tufted buffing pad of constant density. The disclosed method and apparatus of U.S. Pat. No. 3,385,244 is incapable of making a tufted buffing pad of varying density in which the pile density is decreased in low-wear areas and increased in high-wear areas.

From a consideration of the prior art, it appears that no attempt was made to effectively solve the problems presented by tufted buffing pads of constant density across the face surface thereof. The problems, for example, involve tufted buffing pads that wear out quickly, that are wasteful of pile material, and have a low polishing efficiency. Therefore, an object of the present invention is to provide a tufted buffing pad of varied density on the face surface thereof from its center to its outer periphery in which the pile density is increased in the high-wear area and decreased in the low-wear area. This invention will enable a wool reduction of 5 percent to 15 percent and an increase in pile density in the high-wear area of 10 percent to 20 percent. The improved tufted buffing pad will have higher life expectancy and improved polishing efficiency.

SUMMARY OF THE INVENTION

It is an object of this invention to provide an improved tufting apparatus for making tufted buffing pads comprising:

a tufting machine having means for placing pile in a spiral or circular pattern on a backing pad to form a buffing pad;

a rotatable and laterally-movable pad holder for holding the backing pad in a normal home position relative to said pile placing means;

means coupled to said pad holder for intermittently laterally-moving said pad holder from said home position in steps to or from said pile placing means;

a programmable controller coupled to said pad holder moving means; and a computer coupled to said programmable controller for varying the length of the steps that the pad holder is moved laterally for maximizing the pile in a selected high-wear area of the buffing pad and minimizing the pile in a selected low-wear area of the buffing pad.

Another object of the present invention is to provide a method of making a tufted buffing pad of varying density comprising the steps of:

mounting a backing pad on the rotatable spindle of a laterally-movable pad holder;

placing a pile in a spiral or circular pattern on the backing pad to form a tufted buffing pad;

intermittently laterally moving the pad holder in steps from a normal home position to a buffing pad completed position; and controlling the length of the steps by a computer and programmable controller to maximize the pile in a selected high-wear area of the buffing pad, and to minimize the pile in a selected low-wear area of the buffing pad.

Yet another object of the present invention is to provide an improved tufted buffing pad comprising:

a backing pad; and spiral or circular rows of pile secured to the face of the backing pad in which the radially-extending distance between selected rows of pile is decreased to provide a selected high-wear area of the pad, and the radially-extending distance between other selected rows of pile is increased to provide a selected low-wear area of the pad.

BRIEF DESCRIPTION OF THE DRAWINGS

Some of the objects of the invention having been stated, other objects will appear as the description proceeds when taken in connection with the accompanying drawings, in which.

DETAILED DESCRIPTION OF THE INVENTION

While the present invention will be described hereinafter with particular reference to the accompanying drawings, it is to be understood at the outset that persons skilled in the applicable art will be able to modify the present invention while accomplishing the favorable result to be described. Accordingly, the following description is to be understood, from the outset, as a broad teaching disclosure directed to persons skilled in the art, and not as being restrictive upon the scope of the invention.

Figure 1:
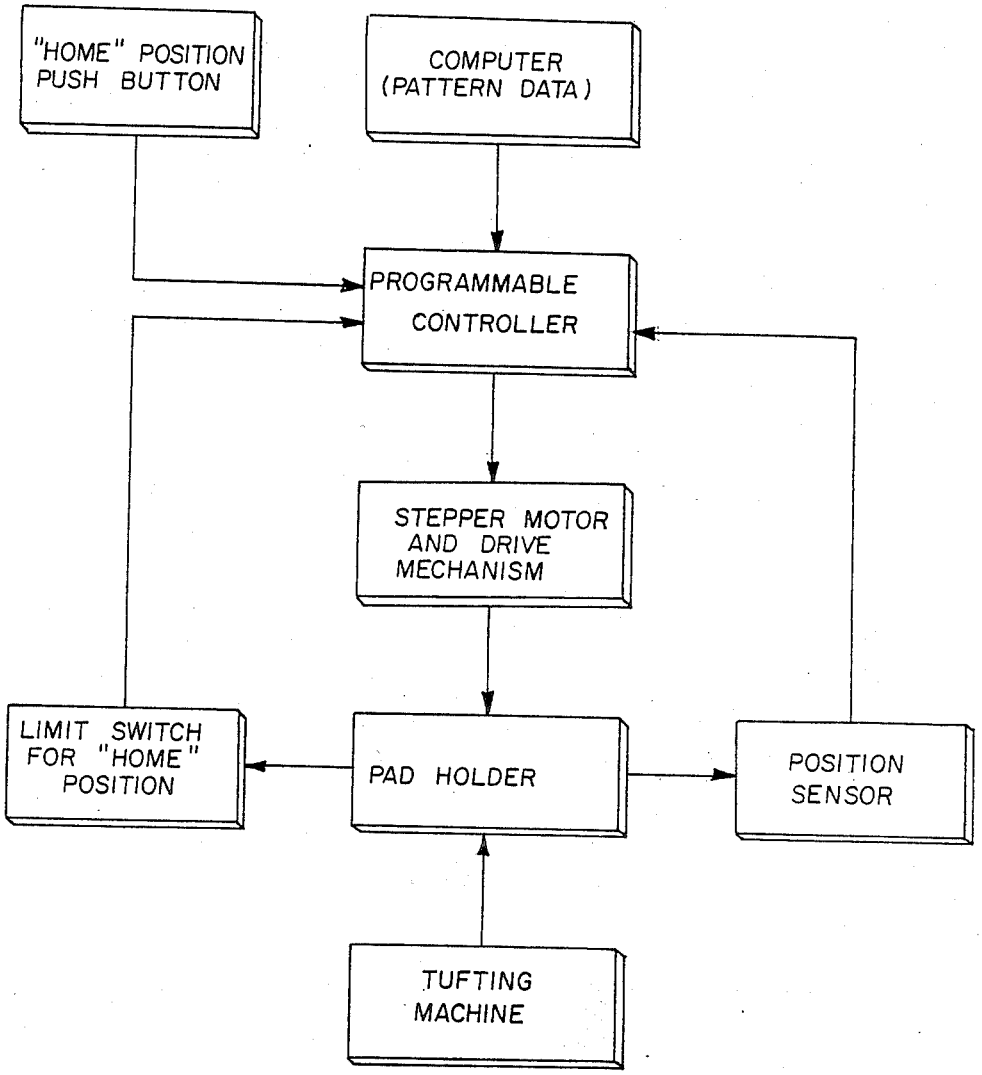
FIG. 1 is a control flow chart in block diagrammatic form of an improved tufting apparatus for making an improved tufted buffing pad in accordance with the present invention.

With reference to FIG. 1, a control flow chart in block diagrammatic form is shown of an improved tufting apparatus for making an improved tufted buffing pad in accordance with the present invention. The tufting apparatus comprises a conventional pad holder for holding a backing pad in relation to a conventional tufting machine, in which a vertical reciprocally-movable needle, not shown, passes through the backing pad for applying circular or spiral rows of pile thereto. A conventional pad feed dog system, not shown, rotates the backing pad about the axis of the pad holder for advancing the pad in synchronism with the tufting cycle of the needle. Movement of the pad holder to and from the tufting machine is achieved by a stepper motor and drive mechanism which is controlled by a programmable controller through a computer. Upon each revolution of the pad holder and backing pad by the tufting machine, a position sensor is actuated for feeding a signal to the programmable controller. In response to circular or spiral pattern data programmed into the computer, the controller actuates the stepper motor and drive mechanism for moving the pad holder one step to or from the tufting machine. Upon completion of the tufted buffing pad, a limit switch is actuated by the pad holder which feeds a signal to the programmable controller for actuating the stepper motor and drive mechanism to return the pad holder to its normal home position. A home position push button is also provided which when manually actuated will return the pad holder to its normal home positon.

In the method and apparatus of this invention, the computer can be any conventional computer with an RS-232 port such as, for example, an IBM PC-XT computer. The programmable controller can be any conventional controller equipped, for example, with one output board, two input boards, one communications board, and three dual-axis stepping motor boards, as provided by the Control Technology Corporation Model 2800 Programmable Controller. The position sensor and limit switch can be any conventional microswitch proximity switch and the home position push button can be any conventional low-voltage switch. The stepper motor and drive mechanism can be any suitable positive indexing means which is mechanically connected to the pad holder for moving the pad holder a controlled distance in steps. As indicated earlier, the tufting machine can be any conventional tufting machine having a reciprocally-movable needle or the like for applying a row of pile to the backing pad while advancing it through a circular or spiral path.

Figure 2:
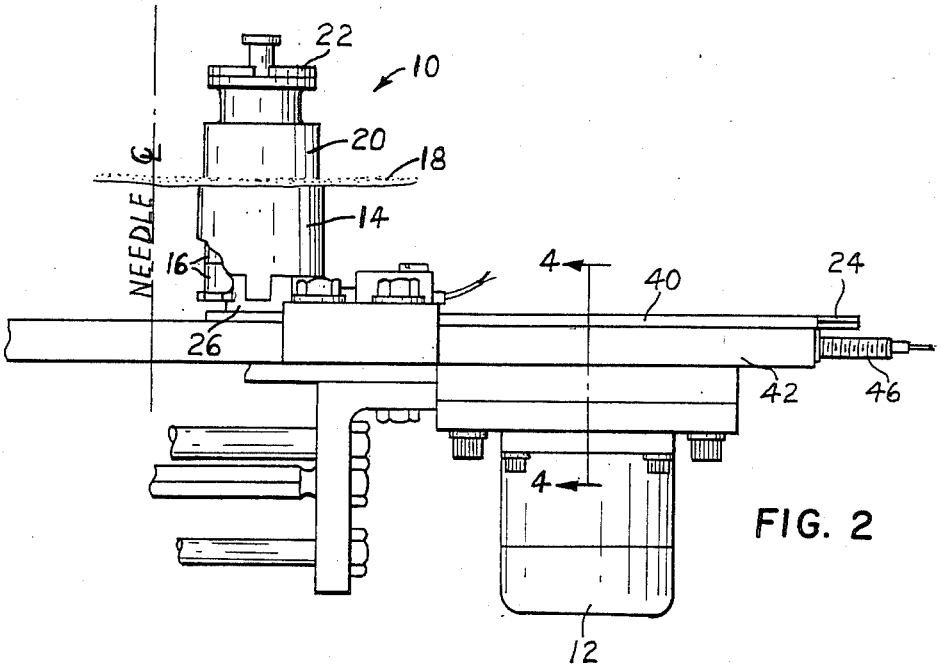
FIG. 2 is a front elevational view of the improved tufting apparatus of the present invention.
Figure 3:
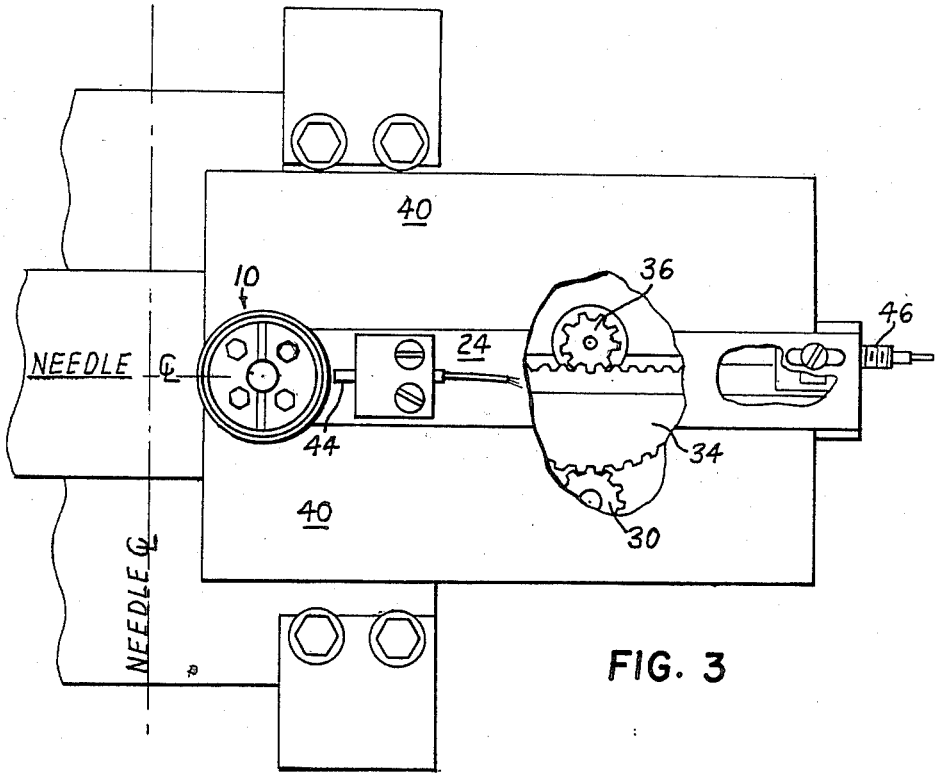
FIG. 3 is a top plan view of the tufting apparatus of FIG. 2 with the backing pad omitted.
Figure 4:
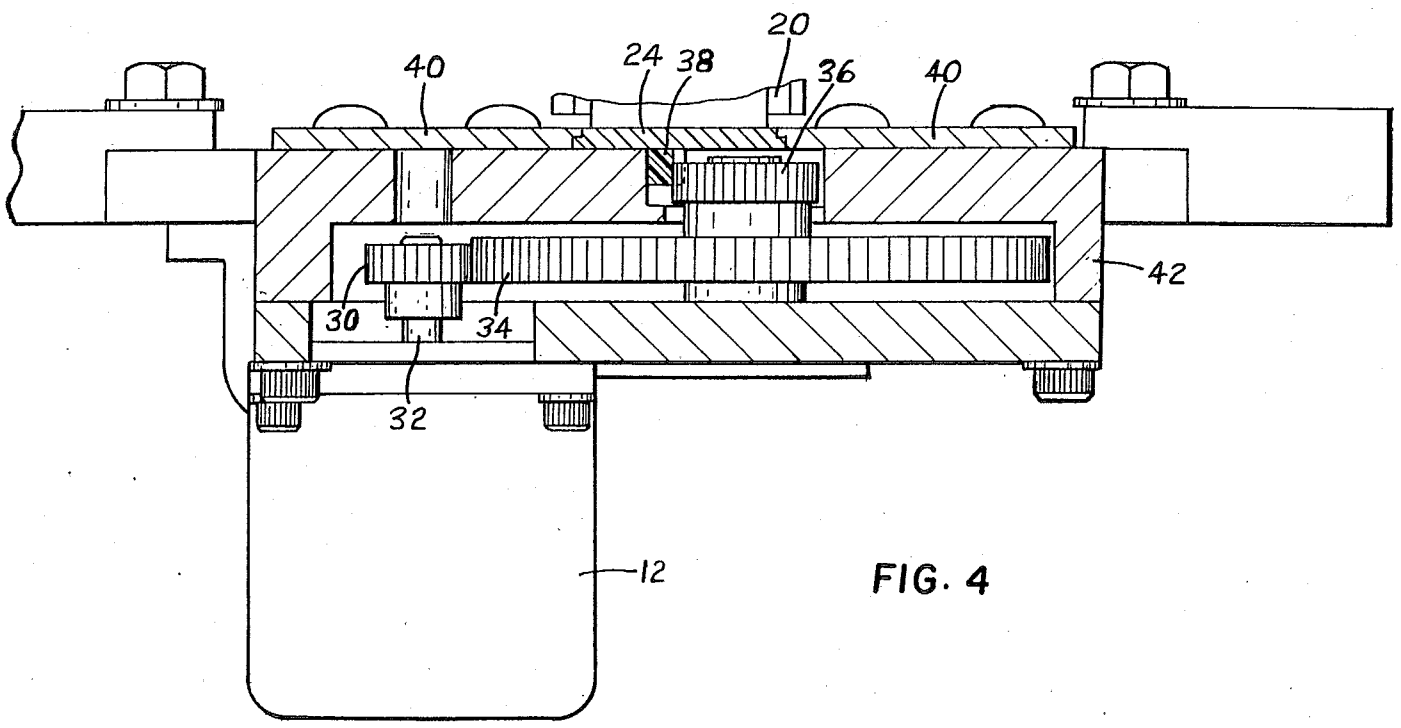
FIG. 4 is a section view taken substantially along line 4—4 of FIG. 2.

With reference to FIGS. 2–4, the pad holder 10 and positive indexing mechanism therefor comprising a stepper motor 12 and drive mechanism will now be described. The pad holder 10 comprises a spindle shell 14 rotatably mounted on radial bearings 16 for supporting a backing pad 18 held thereon by a spindle cap 20 and cap plate 22. The pad holder 10 is secured to a slide plate 24 through a slide-bearing spacer 26. The pad holder 10 and slide plate 24 are reciprocally movable in steps of varying length relative to needle center-line positions by a drive mechanism driven by stepper motor 12. The drive mechanism comprises a gear train comprising a spur gear 30 mounted on the stepper motor output shaft 32, a nylon gear 34 in meshing engagement with spur gear 30, and a pinion 36 in meshing engagement with a gear rack 38 secured to slide plate 24. The gear 34 and pinion 36 are rotatably driven together on a common post, not shown. The slide plate 24 is slidably movable between side plates 40 on a frame 42 which also supports stepper motor 12. A position sensor 44 is mounted on frame 42 adjacent pad holder 10, as best seen in FIG. 3, and limit switch 46 is mounted at one end of frame 42.

Figure 5:
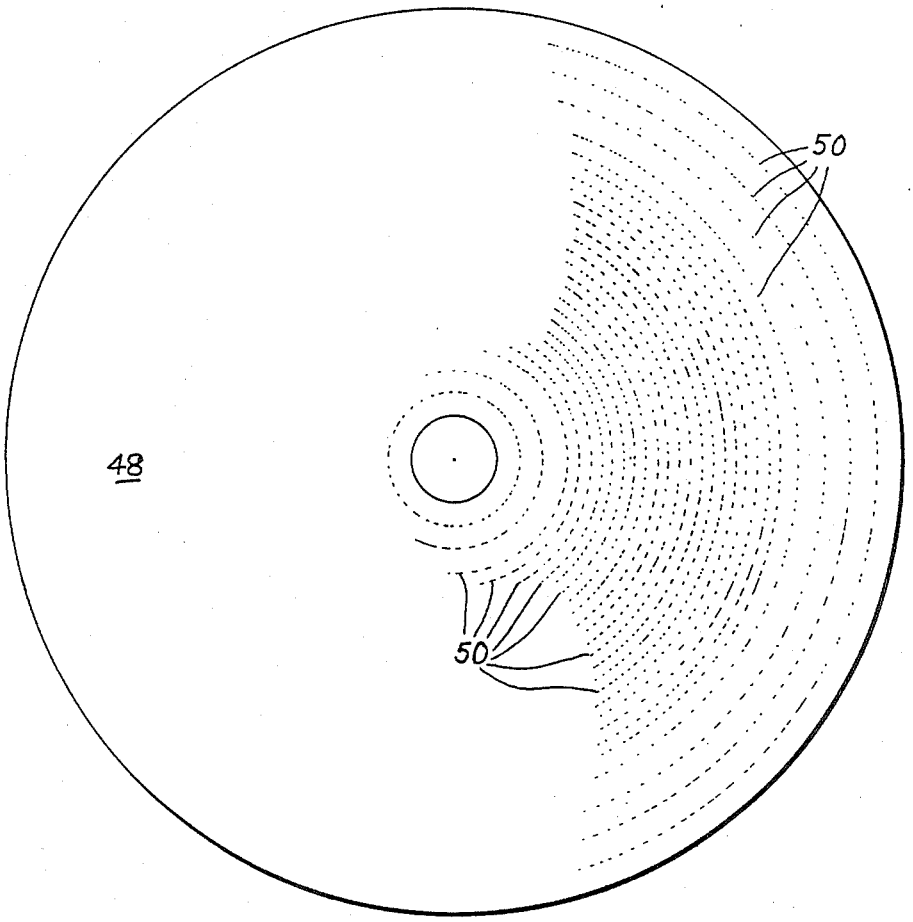
FIG. 5 is a top plan view of an improved tufted buffing pad made in accordance with the present invention.

With reference to FIG. 5, an improved tufted buffing pad 48 of this invention is shown comprising backing pad 18 onto which a plurality of circular rows 50 of tufted pile are placed by the tufting machine. By virtue of pattern data programmed into the computer, lateral movement of pad holder 10 to and from the tufting machine is controlled through the programmable controller and stepper motor 12 and drive mechanism for varying the length in distance of the steps that pad holder 10 is moved after completion of each revolution of backing pad 18. By properly programming the computer, a tufted buffing pad 48 is manufactured in which the steps or distance between rows 50 in selected low-wear areas of the pad are increased, and the steps or distance between the rows in the high-wear area of the pad are decreased. This results in a buffing pad 48 in which the pile is maximized in a selected high-wear area of the pad and minimized in a selected low-wear area of the pad. The location of selected high-wear and low-wear areas on the surface of the pad can be varied by properly programming the computer to produce tufted buffing pads 48 designed for specific buffing or polishing operations.

The invention has been described in detail which particular reference to a preferred embodiment thereof, but it will be understood that variations and modifications can be effected within the spirit and scope of the invention.

What is claimed is:

1. An improved tufted buffing pad comprising:

a backing pad; and spiral or circular rows of pile secured to said backing pad in which the radially-extending distance between selected rows of pile is decreased to provide a selected high-wear area of the pad, and the radially-extending distance between other selected

2. A tufted buffing pad according to claim 1 wherein the backing pad is formed from any suitable fabric material, and said pile is formed from a wool yarn.

* * * * *